US007435707B2

(12) United States Patent
Langer et al.

(10) Patent No.: US 7,435,707 B2
(45) **Date of Patent: *Oct. 14, 2008**

(54) OIL-IN-WATER EMULSIONS AND A METHOD OF PRODUCING

(75) Inventors: Deborah A. Langer, Chesterland, OH (US); Brian B. Filippini, Mentor-on-the-Lake, OH (US); Thomas F. Steckel, Chagrin Falls, OH (US); David L. Westfall, Lakewood, OH (US); Richard A. Denis, Auburn Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 654 days.

This patent is subject to a terminal disclaimer.

(21) Appl. No.: 10/657,671

(22) Filed: Sep. 8, 2003

(65) Prior Publication Data

US 2004/0053791 A1 Mar. 18, 2004

Related U.S. Application Data

(63) Continuation-in-part of application No. 10/154,276, filed on May 23, 2002, now Pat. No. 6,933,263.

(51) Int. Cl.

| | |
|---|---|
| ***C10M 133/16*** | (2006.01) |
| ***C10M 169/06*** | (2006.01) |
| ***C10M 169/04*** | (2006.01) |
| ***C10M 169/02*** | (2006.01) |

(52) U.S. Cl. ..... 508/291; 508/154

(58) Field of Classification Search ..... 508/154, 508/180, 208, 421, 545, 583, 291; 516/21
See application file for complete search history.

(56) References Cited

U.S. PATENT DOCUMENTS

| | | | | |
|---|---|---|---|---|
| 2,466,647 | A * | 4/1949 | Stern | 508/407 |
| 4,948,521 | A * | 8/1990 | Stewart et al. | 508/143 |
| 5,026,865 | A * | 6/1991 | Karol | 548/142 |
| 5,256,320 | A | 10/1993 | Todd et al. | 252/32.007 |
| 5,354,485 | A | 10/1994 | Tipton et al. | 252/34 |
| 5,362,409 | A | 11/1994 | Wiggins et al. | 252/32.7 |
| 5,484,542 | A * | 1/1996 | Cahoon et al. | 508/186 |
| 6,020,291 | A * | 2/2000 | Lange et al. | 508/404 |
| 6,063,742 | A | 5/2000 | Konzman | 508/368 |
| 6,824,623 | B1 | 11/2004 | Gross et al. | 134/36 |
| 2002/0045670 | A1 * | 4/2002 | Lorant | 516/8.1 |
| 2003/0019552 | A1 * | 1/2003 | Pollack et al. | 149/46 |
| 2004/0176263 | A1 * | 9/2004 | Filippini et al. | 510/201 |
| 2005/0120619 | A1 * | 6/2005 | Koch et al. | 44/301 |

FOREIGN PATENT DOCUMENTS

| | | |
|---|---|---|
| CA | 914144 | 11/1972 |
| EP | 0340323 | 11/1989 |
| GB | 1591652 | 6/1981 |
| WO | WO00/00572 | 1/2000 |

OTHER PUBLICATIONS

The Kirk-Othmer Encyclopedia of Chemical Technology, vol. 8, 3rd Edition, pp. 900-930.*

Lynn, J.L., and Bory, B.H., Surfactants, in Kirk-Othmer Encyclopedia of Chemical Technology, posted online Dec. 4, 2000, and retrieved from the internet at http://mrw.interscience.wiley.com/emrw/9780471238966/kirk/article/surflynn.a01/rel0001/html on Jan. 2, 2008, p. 27.*

"The HLB System, a time-saving guide to emulsifier selection", ICI United States Inc., (12976), pp. 1-20.

* cited by examiner

*Primary Examiner*—Glenn Caldarola
*Assistant Examiner*—Jim Goloboy
(74) *Attorney, Agent, or Firm*—Christopher D. Hilker; David M. Shold

(57) ABSTRACT

The invention relates to a novel emulsified composition containing (a) major amount of an aqueous phase, (b) a minor amount of an organic phase (c) a thickener and (d) a minor but effective amount of at least one emulsifier to emulsify the aqueous and organic phase resulting in a water in oil emulsifeid composition, in particular emulsified greases and emulsified coatings. Further, the present invention provides a process for making the emulsified composition.

11 Claims, No Drawings

OIL-IN-WATER EMULSIONS AND A METHOD OF PRODUCING

This is a continuation in part of Ser. No. 10/154,276, now U.S. Pat. No. 6,933,263 entitled "Emulsified Based Lubricants" filed May 23, 2002.

TECHNICAL FIELD OF THE INVENTION

The invention relates to a water in oil composition. These water in oil emulsions are useful as of for lubricants, waxes, greases, coatings corrosion protection, oxidation protection, water protection and the like.

BACKGROUND OF INVENTION

Lubricating compositions are used to reduce friction between surfaces which are moving with respect to each other. The lubricant reduces the amount of intimate contact between the moving surfaces. The lubricant prevents contact between the moving surfaces thus preventing harmful wear to the surfaces. The lubricant generally lowers the coefficient of friction. To be effective, the lubricant, in particular a grease, needs sufficient anti-wear, anti-weld and extreme pressure properties to prevent metal to metal contact under high load conditions.

Generally, most lubricants have been based on petroleum oil, although synthetic based oil lubricants, have been used for special applications. Grease compositions contain an oil of lubricating viscosity and a thickening agent. Greases usually include various types of thickeners. Thickeners include simple metal soaps, complex metal salt soap and non-soap thickeners, like clays. Greases are typically made by thickening an oil with a thickener and the addition of additives for performance benefits.

Coating compositions are useful to apply as a film or thin layer to a substrate, which may or may not be in contact with the substrate. Generally, coatings are efficient barriers to molecules from the environment. Coatings are needed to protect the substrate as a barrier to environmental elements, for corrosion protection, oxidation protection, water protection and the like.

Frequently lubricating oils, greases and coatings come into contact with the environment through leakage, excretion of old lubricants during reapplication, general disposal, mechanical removal, water washout, thermal degradation and the like. The release of lubricants, greases and coating pose an environmental concern. The development of materials which contain a majority of water and natural products will lessen environmental contamination or impact which would result through the use of currently used mineral or synthetic oil-based lubricants, greases and/or coatings.

It has been discovered that an emulsified composition can be used in some of the same applications as conventional lubricants and greases and is environmentally friendly, less expensive, less toxic and less flammable. Additionally, the development of an emulsified coating to protect the substrate from oxidation, corrosion and other environmental materials is needed.

The coating may be translucent or opaque, temporary or permanent coating. The translucent or opaque barrier coatings may be used for painted surfaces such as automobiles, trucks and boats. The translucent or opaque barrier coatings may be used for painted surfaces including carbon steel, stainless steel, aluminum, titanium, copper, brass, iron, plastic and fiberglass.

The emulsifier composition provides corrosion protection, water protection and/or oxidation protection on walls, automobiles, trucks, heavy industrial mobile equipment, boats and stationary structures. Material for lubricating during cold heading application in manufacturing bolts.

Further the emulsified composition is useful in any metalworking application that provides lubrication and/or corrosion and/or oxidation protection during metal fabrication of aluminum, ferrous and metal products such as rolling, drawing, stamping, and forging of ball bearings. Other metalworking application that the emulsified composition is useful in lubrication and/or corrosion and/or oxidation protection during metal removal such as cutting, grinding, drilling and milling.

SUMMARY OF THE INVENTION

The invention relates to novel emulsified composition comprising (a) a major amount of an aqueous phase, (b) a minor amount of an organic phase and (c) a minor but effective amount of at least one emulsifier to emulsify the aqueous and organic phase resulting in a water in oil emulsified composition.

More particularly the emulsified composition comprises (a) a major amount of water, (b) optionally water soluble additives, (c) optionally alcohols, (d) an oil, optionally of lubricating viscosity, (e) at least one emulsifier and (f) optionally oil soluble additives, resulting in a water in oil emulsified composition.

The present invention provides a process for making an emulsified composition comprising:

A. mixing the following components (a) a major amount of water, (b) a minor amount of oil optionally of lubricating viscosity, (c) at least one emulsifier, (d) optionally, a water soluble additive, (e) optionally, an oil soluble additive, (f) optionally, an alcohol, (g) optionally, a thickener, and (h) combinations thereof;

B. with sufficient shear to form a water in oil emulsion.

The emulsified composition is a stable water in oil emulsion and can be environmentally friendly. The emulsified composition can be used as lubricants, greases and coatings.

DETAILED DESCRIPTION OF THE INVENTION

The present invention relates to emulsified compositions in particular emulsified greases and emulsified coatings and a process to make it. The emulsion is a water in oil emulsion i.e., the oil forms the continuous phase while the water forms the discontinuous phase dispersed in the continuous phase. The emulsion has a viscosity in the range of about 200 to about greater than 2,000,000 cps or $mm^2$/sec measured on a Brookfield Viscometer with a No. 7 spindle at 20 rpm and 25° C. The emulsions can also be of a consistency which allows them to be evaluated on a penotrometer according to the ASTM D217 procedure. If measured using the ASTM D217 test, emulsions with penetrations greater than 85 (8.5 mm of penetration) can be obtained.

Natural oils include animal oils and plant oils (e.g., castor oil, cottonseed oil, rapeseed oil, soybean oil, lard oil) as well as liquid petroleum oils and solvent-treated or acid-treated mineral lubricating oils of the paraffinic, naphthenic or mixed paraffinic-naphthenic types. Oils derived from coal or shale are also useful base oils. In one embodiment the oils are of lubricating viscosity. Synthetic lubricating oils include but are not limited to hydrocarbon oils such as polymerized and interpolymerized olefins (e.g., polybutylenes, polypropylenes, propylene-isobutylene copolymers, poly(1-hexenes, poly(1-octenes), poly(1-decenes), and mixtures thereof); alkylbenzenes (e.g., dodecylbenzenes, tetradecylbenzenes, dinonylbenzenes, and di(2-ethylhexyl)-benzenes); polyphenyls (e.g., biphenyls, terphenyls, and alkylated polyphenyls), alkylated diphenyl ethers and alkylated diphenyl sulfides and the derivatives, analogs, and homologs thereof.

Alkylene oxide polymers and interpolymers and derivatives thereof where the terminal hydroxyl groups have been modified by esterification, etherification, or similar reaction constitute another class of known synthetic lubricating oils. These are exemplified by the oils prepared through polymerization of ethylene oxide, propylene oxide or butylenes oxide the alkyl and aryl ethers of these polyoxyalkylene polymers (e.g., methylpolyisopropylene glycol ether having an average molecular weight of 1,000 diphenyl ether of polyethylene glycol having a molecular weight of 500-1,000, diethyl ether of polypropylene glycol having a molecular weight of 1,000-1,500) or mono- and polycarboxylic esters thereof, for example, the acetic acid esters, mixed $C_3$-$C_8$ fatty acid esters, or the $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include but are not limited to dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include but are not limited to those made from $C_5$ to $C_{12}$ monocarboxylic acids and polyols and polyol ethers such as neopentyl glycol, trimethylolpropane, pentaerythritol, dipentaerythritol, and tripentaerythritol.

Unrefined, refined and rerefined oils (and mixtures of each with each other) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such a solvent extraction, acid or base extraction, filtration, percolation, or similar purification techniques. Re-refined oils are obtained by processes similar to those used to obtain refined oils. Such rerefined oils are also known as reclaimed or reprocessed oils and often are additionally processed by techniques directed to removal of spent additives and oil breakdown products.

Petroleum, synthetic and natural waxes and mixtures of the type disclosed hereinabove can be used in the compositions of the present invention. Petroleum waxes are paraffinic compounds isolated from crude oil via some refining process. Examples of petroleum waxes are slack wax and paraffin wax. Synthetic waxes are waxes derived from petrochemicals, such as ethylene or propylene. Synthetic waxes include polyethylene, polypropylene, and ethylene-propylene co-polymers. Natural waxes are waxes produced by plants and/or animals or insects. These waxes include bees wax, soy wax and carnauba wax. Petrolatum may also be used in these compositions.

In one embodiment, the oil is soybean oil. In another embodiment, the oil is mineral oil. In another embodiment, the preferred oil is wax thickened mineral oil or vegetable oil. In another embodiment, the oil is a complex or conventional lithium grease.

The emulsified composition contains oil in the range from about 1% to about 95%, preferably from about 5% to about 40% and more preferably from about 8% to about 20% by weight of the emulsified composition.

The major amount of the emulsified composition is water. The water may be taken from any source. The water includes but is not limited to tap, deionized, demineralized, purified and the like. Combinations of different sources of water may be used. The water is present in the range of about 99% to about 5%, preferably 95% to about 60% and more preferably about 92% to about 80% of the emulsified composition.

Conventional thickeners that are either water soluble, oil soluble, or combinations thereof may optionally be used in the preparation of the emulsified composition. Thickeners for the emulsified composition are generally known in the art.

The oil phase thickeners include but are not limited to alkali and alkaline earth metal soaps of fatty acids and fatty materials, the metals are typified by sodium, lithium, calcium, magnesium and barium, and examples of fatty materials include stearic acid, hydroxystearic acid, steering, oleic acid, politic acid, muriatic acid, cottonseed oil acids, and hydrogenated fish oils. Other thickeners include but are not limited to salt and salt-soap complexes, such as calcium separate-acetate, barium separate-acetate, calcium stearate-caprylate-acetate complexes, calcium salts and soaps of low, intermediate and high molecular weight acids and of nut oil acids, aluminum separate, aluminum complex thickeners and lithium 12-hydroxy separate. Useful thickeners include, but are not limited to, clays, which can be treated to render them hydrophobic. Typically, these clays are treated with ammonium compounds, such as tetraalkyl ammonium chlorides. These clays are generally crystalline complex silicates. These clays include bentonite, attapulgite, hectorite, illite, saponite, sepiolite, biotite, vermiculite, zeolite clays and the like. Combinations of the thickeners may be used.

Materials that may be classified as 'viscosity modifiers' can also be used as thickeners for these systems. These thickeners can also include polyacrylates; poly methacrylates; olefin co-polymers; functionalized olefin copolymers, such as reaction products with maleic anhydride; ethylene/propylene/diene terpolymers; functionalized ethylene/propylene/diene terpolymers, such as reaction products with maleic anhydride; the esterified reaction products of maleic anhydride/styrene co-polymers; styrene-butadiene copolymers and similar compositions apparent to those skilled in the art.

The water phase includes water soluble additives that include but are not limited to alcohols; water soluble extreme pressure (EP) antiwear additives; water soluble additives such as dihydrogen butyl phosphate, water soluble phosphate salts, water soluble dithiophosphate salts; water soluble inorganic salts which may give added EP antiwear protection such as xanthates, dithiocarbonates, trithiocarbonates, sulfates, sulfites, sulfides, for example sodium sulfide and the like; water soluble phosphate esters, phosphites, phosphonates, and the like; water soluble dithiophosphate esters; water soluble rust inhibitors such as but not limited to amines like morpholine and alkanolamines, phosphorous and phosphoric acid derivatives such as mono and diesters and amine or metallic salts of phosphoric and phosphorous acid and combinations thereof.

The water soluble additives are added to enhance the performance of the emulsified composition. The water soluble additives are preferably present in the range of about 0% to about 50%, preferably about 0.1% to about 30% and more preferably about 1% to about 20% by weight of the emulsified composition.

The water phase thickeners include but are not limited to surfactant gels which are two or more surfactants that associate with each other to form a gel. An example of a surfactant gel/surfactant combination is lauryl sulfobetaine and cationic surfactants. The water phase thickeners further include but are not limited to water-soluble polymeric thickeners. Generally, these thickening agents can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Examples include but are not limited to gums, and are gum agar, guar gum, gum arabic, algin, dextrans, xanthan gum and the like.

Also among the polysaccharides that are useful as thickeners are cellulose ethers and esters. Examples include but are not limited to are hydroxethyl cellulose and the sodium salt of carboxymethyl cellulose. Mixtures of two or more of any such thickeners are also useful.

The water phase thickeners can also be synthetic thickening polymers. Many such polymers are known to those of skill in the art. Representative of them include but are not limited to polyacrylates, polyacrylamides, hydrolyzed vinyl esters, water-soluble homo- and inter-polymers of acrylarnidoalkane sulfonates containing 50 mole percent at least of acryloamido alkane sulfonate and other comonomers such as acrylonitrile, styrene and the like. Poly-n-vinyl pyrrolidones and homo- and copolymers as well as water-soluble salts of styrene-maleic anhydride copolymers and isobutylene-maleic anhydride copolymers can also be used as thickening agents.

The water phase thickeners may also be mineral-based. Many mineral based thickeners are known. Examples include hydrated silica and hydrated magnesium aluminum silicates.

The thickener is employed in an amount from about 0% to about 10%, preferably from 0.2% to about 7% and more preferably about 0.3% to about 5% by weight of the emulsified composition.

The emulsified composition may contain oil soluble additives in the oil continuous phase that are conventionally employed in lubricants. The oil soluble additives include but are not limited to extreme pressure (EP) anti-wear additives, metal deactivators, dispersants, antifoams, corrosion and rust inhibitors, antioxidants, detergents, polymers and functionalized polymers and others useful additives for providing enhanced performance characteristics of the emulsified composition and are known in the art. The amount of the organic soluble additive depends on the specific performance characteristics designed for the emulsified composition and is generally in the range of about 0% to about 75%, preferably from about 0.5% to about 60% and more preferably from about 1% to about 20% of the emulsified composition.

Extreme pressure anti-wear additives that are soluble in the oil include but are not limited to a sulfur or chlorosulphur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl) disulfide, dubutyl tetrasulfide, sulfurized sperm oil, sulfurized vegetable and or animal oils, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite, metal thiocarbamates, such as zinc dioctyldithiocarbamate and barium heptylphenol diacid, such as zinc dicyclohexyl phosphorodithioate and the zinc salts of a phosphorodithioic acid. Additionally, dithiophosphate and dithiocarbamate esters and disulfides, and mixtures of mono- and dialkylphosphates salted with alkyl amines may also be used. Combinations of the above may be used.

The oil soluble EP agents are present in the range of about 0% to about 12%, preferably from about 0.5% to about 10% and more preferably from about 1% to about 6% by weight of the emulsified composition.

Solid additives in a particle or finely divided form may also be used at levels of 0% to 20%. These include but are not limited to graphite, molybdenum disulfide, zinc oxide, boron nitride, polytetrafluoroethylene, and the like. Mixtures of solid additives may be used.

Oil soluble polymers and functionalized polymers include but are not limited to polyisobutenes, polymethacrylate acid esters, polyacrylate acid esters, diene polymers, polyalkyl styrenes, alkenyl aryl conjugated diene copolymers, polyolefins and multifunctional viscosity improvers, including dispersent viscosity modifiers (which impart both dispersancy and viscosity improvement). The polymers may also be used to provide tackiness to the emulsified composition. Combinations may be used.

The oil soluble polymers including functionalized polymers are present in the range of about 0% to about 50%, preferably, about 0.01% to about 25%, and more preferably about 0.02% to about 18% by weight of emulsified composition.

The antioxidants that are oil soluble are known in the art and include but are not limited to phenate sulfides, phosphosulfurized terpenes, sulfurized esters, aromatic amines, and hindered phenols. Another example of an antioxidant is a hindered, ester-substituted phenol, which can be prepared by heating a 2,6-dialkylphenol with an acrylate ester under base catalysis conditions, such as aqueous KOH. Combinations may be used. The antioxidants are present in the range of about 0% to about 10%, preferably about 0.25% to 6%, and more preferably about 0.5% to about 3% by weight of the emulsified composition.

Metal deactivators useful in lubricating oil compositions are known in the art and include but are not limited to benzotriazole, benzimidazole, 2-alkyldithio-benzimidazoles, 2-alkyldithiobenzothiazoles, 2-(N,N-dialkyldithiocarbamoyl)-benzothiazoles, 2,5-bis(alkyl-dithio)-1,3,4-thiadiazoles, and 2,5-bis(N,N-dialkyl-dithiocarbamoyl)-1,3,4-thiadiazoles. Combinations may be used. The metal deactivators are present in the range of 0% to about 5% preferably about 0.1% to about 4% and more preferably about 0.2% to about 3% by weight of the emulsified composition.

Oil soluble detergents are known in the art and include but are not limited to overbased materials prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compounds useful in making overbased compositions in general can include carboxylic acids, sulfonic acids, phosphorus-containing acids, phenols or mixtures of two or more thereof.

The metal compounds useful in making the basic metal salts are generally any Group I or Group II metal compounds (CAS version of the Periodic Table of the Elements). The Group I metals of the metal compound include alkali metals (group IA: sodium, potassium, lithium, etc.) as well as Group IB metals such as copper. The Group I metals are preferably sodium, potassium, lithium and copper, more preferably sodium or potassium, and more preferably sodium. The Group II metals of the metal base include the alkaline earth metals (group IIA: magnesium, calcium, barium, etc.) as well as the Group IIB metals such as zinc or cadmium. Preferably the Group II metals are magnesium, calcium, or zinc, preferably magnesium or calcium, more preferably calcium. Generally the metal compounds are delivered as metal salts. The anionic portion of the salt can be hydroxyl, oxide, carbonate, borate, nitrate, etc.

While overbased metal salts can be prepared by combining an appropriate amount of metal base and carboxylic acid substrate, the formation of useful overbased compositions is facilitated by the presence of an additional acidic material. The acidic material can be a liquid such as formic acid, acetic acid, nitric acid, sulfuric acid, etc.

A promoter is a chemical employed to facilitate the incorporation of metal into the basic metal compositions. The promoters are quite diverse and are well known in the art, as evidenced by the cited patents. These include but are not limited to the alcoholic and phenolic promoters. The alcoholic promoters include the alkanols of one to about twelve carbon atoms such as methanol, ethanol, amyl alcohol, octanol, isopropanol, and mixtures of these and the like. Phenolic promoters include a variety of hydroxy-substituted benzenes and naphthalenes. Mixtures of various promoters are sometimes used. The promoters are found in U.S. Pat. Nos. 2,777,874 and 2,616,904.

Combinations of detergents may be used. The detergents are present in the range of about 0% to about 8%, preferably, about 0.1% to about 6%, and more preferably about 0.3% to about 5% by weight of emulsified composition.

Antifoams are known in the art and include but are not limited to organic silicones such as dimethyl silicone and the like. Combinations may be used. The antifoams are present in the range of about 0% to about 2%, preferably about 0.01% to about 1%, and more preferably 0.02% to about 0.7% by weight of the emulsified composition.

Antirust compounds are known in the art and include but are not limited to alkyl substituted aliphatic dicarboxylic acids such as alkenyl and succinic acids, sulfonates relating to the metal detergent, sodium nitrite, oxidized wax, calcium salts of oxidized paraffin wax, magnesium salts of oxidized paraffin wax, alkali metal salts, alkaline earth metal salts or amnine salts of beef tallow fatty acids, alkenyl succinates or alkenyl succinic acid half esters (whose alkenyl moiety has a molecular weight of about 100 to 300), glycerol monoesters, nonylphenyl ethoxylate, lanolin fatty acid esters, and calcium salts of lanolin fatty acids. Combinations may be used. The antirust compounds are present in the range of about 0% to about 10%, preferably about 0.1% to about 8%, and more preferably 0.2% to about 6% by weight of the emulsified composition.

Emulsifiers

The emulsified composition contains at least one emulsifier. The emulsifier must be capable of producing a water in oil emulsion to form the emulsified composition. Examples of suitable emulsifiers include but are not limited to alkylaryl sulfonate, lignosulfonate salts, starches and the like. Low hydrophilic lipophilic (sometimes called lyophilic) balance (HLB) surfactants are employed within a range of less than or equal to HLB 9.0, preferably HLB of 0 to 7, and more preferably with an HLB in the range of 4 to 6. Surfactants with HLBs higher than 9 can be used provided they are combined with lower HLB surfactants to give a composite emulsifier system with an HLB in the range that produces water in oil emulsions. The procedures to do this are generally known in the art.

The emulsifier is present at a level of 0.1-20%, more preferably 0.1-10% or more preferably 0.3-7.0%.

The emulsifier includes but is not limited to (i) a oil soluble product made by reacting at least one hydrocarbyl-substituted carboxylic acid acylating agent with ammonia or an amine including but not limited to alkanol amine, hydroxy amine, and the like, the hydrocarbyl substituent of said acylating agent having about 50 to about 500 carbon atoms;

(ii) any other acylating agent having at least one hydrocarbyl substituent of up to about 40 carbon atoms, and reacting that said acylating agent with ammonia or an amine;

(iii) any other ionic or a nonionic compound having a hydrophilic-lipophilic balance (HLB) of about 1 to about 40;

(iv) the reaction product of polyacidic polymer with at least one oil soluble product made by reacting at least one hydrocarbyl-substituted carboxylic acid acylating agent with ammonia, an amine, a polyamine, an alkanol amine or hydroxy amines;

(v) an amino alkylphenol which is made by reacting an alkylphenol, an aldehyde and an amine resulting in an amino alkylphenol;

(vi) a hydrocarbyl substituted carboxylic acid, or a reaction product of the hydrocarbyl substituted carboxylic acid or a reactive equivalent of such acid with an alcohol, the hydrocarbyl substituent of the acid or reactive equivalent thereof containing at least about 30 carbon atoms;

(vii) at least one compound represented by one or more of the formulae:

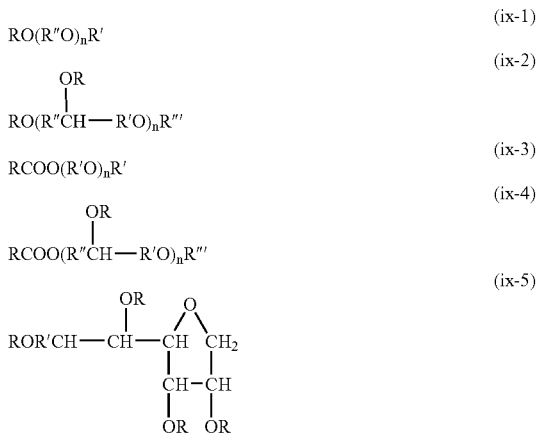

(ix-1)

(ix-2)

(ix-3)

(ix-4)

(ix-5)

-continued

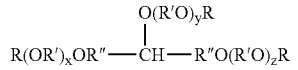

(ix-6)

wherein each R is independently hydrogen or a hydrocarbyl group of up to about 60 carbon atoms; each R' and R" is independently an alkylene group of 1 to about 20 carbon atoms; each R'" is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1. This emulsifier is further disclosed in Applicants U.S. application entitled "Water Blended Fuel Composition", Applicants' U.S. Ser. No. 10/319,125 filed Dec. 13, 2002, incorporated by reference herein;

(viii) an etheramine used to the make the composition of this invention can be represented by the formula

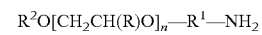

wherein each n is a number from 0 to 50; each R is selected from the group consisting of hydrogen, hydrocarbyl groups of 1 to 16 carbon atoms, and mixtures thereof; each R.susp.l is selected from the group consisting of a hydrocarbylene group containing 2 to 18 carbon atoms and a group represented by the formula

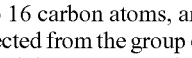

wherein both $R^6$ and $R^7$ are hydrocarbylene groups of 3 to 10 carbon atoms and p is a number from 1 to 4; and each $R^2$ is a hydrocarbyl group having a valence of y where y is a number from 1 to 3, and containing 1 to 50 carbon atoms when y is 1 and 1 to 18 carbon atoms when y is 2 or 3; provided that when n is zero, y is 1;

(ix) a phospholipid, any lipid containing a phosphoric acid, such as lecithin or cephalin; or (x) An amine represented by the formula:

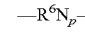

where R=a poly(isobutenyl) group of molecular weight between 350 and 3000.

(xi) The combination of any other above listed emulsifiers.

The oil-soluble product (i) of the emulsifier may be at least one oil-soluble product made by reacting at least one hydrocarbyl-susbstituted carboxylic acid acylating agent with ammonia or an amine including but not limited to alkanol amines, hydroxyl amines, and the like, the hydrocarbyl substituent of said acylating agent having about 50 to 500 carbon atoms, and is described in greater detail in U.S. Pat. No. 6,419,714, An Emulsifer For An Aqueous Hydrocarbon Fuel, incorporated by reference herein.

The hydrocarbyl-substituted carboxylic acid acylating agents may be carboxylic acids or reactive equivalents of such acids. The reactive equivalents may be acid halides, anhydrides, or esters, including partial esters and the like. The hydrocarbyl substituents for these carboxylic acid acylating agents may contain from about 50 to about 500 carbon atoms, and in one embodiment about 50 to about 300 carbon atoms, and in one embodiment about 60 to about 200 carbon atoms. In one embodiment, the hydrocarbyl substituents of these acylating agents have number average molecular weights of about 700 to about 3000, and in one embodiment about 900 to about 2300.

In another embodiment, the oil soluble product (i) of the present invention comprises an emulsifying amount of at least one of a oil-soluble hydrocarbyl-substituted carboxylic acylating agent and a reaction product of said acylating agent with at least one of ammonia, an amine, an alcohol, a reactive metal, a reactive metal compound or a mixture of two or more thereof, wherein the hydrocarbyl substituent comprises a group derived from at least one polyolefin, said polyolefin having $\overline{M}_w/\overline{M}_n$ greater than about 5.

The hydrocarbyl substituted acylating agents have a hydrocarbyl group substituent that is derived from a polyolefin, with polydispersity and other features as described below. Generally, it has a number average molecular weight of at least 600, 700, or 800, to 5000 or more, often up to 3000, 2500, 1600, 1300, or 1200. The polyolefin polymer may be a polyisobutene, polypropylene, polyethylene, a copolymer derived from isobutene and butadiene, or a copolymer derived from isobutene and isoprene. The hydrocarbyl group is typically derived from a polyolefin or a polymerizable derivative thereof, including homopolymers and interpolymers of olefin monomers having 2 to 30, to 6, or to 4 carbon atoms, and mixtures thereof. In a preferred embodiment the polyolefin is polyisobutene.

Suitable olefin polymer hydrocarbyl groups, having suitable polydispersity, can be prepared by heteropolyacid catalyzed polymerization of olefins under conventional conditions. Preferred heteroplyacids include a phosphotungstic acid, a phosphomolybidc acid, a silicotungstic acid, a silicomolybdic acid and the like.

The hydrocarbyl-substituted carboxylic acid acylating agents may be made by reacting one or more alpha-beta olefinically unsaturated carboxylic acid reagents containing 2 to about 20 carbon atoms, exclusive of the carboxyl groups, with one or more olefin polymers as described more fully hereinafter.

In one embodiment, the hydrocarbyl-substituted carboxylic acid acylating agent is a polyisobutene-substituted succinic anhydride, the polyisobutene substituent having a number average molecular weight of about 1,500 to about 3,000, and in one embodiment about 1,800 to about 2,300, said first polyisobutene-substituted succinic anhydride being characterized by about 1.3 to about 2.5, and in one embodiment about 1.7 to about 2.1, in one embodiment about 1.0 to about 1.3, and in one embodiment about 1.0 to about 1.2 succinic groups per equivalent weight of the polyisobutene substituent.

The oil soluble product (i) may be formed using ammonia, an amine and/or the metal bases of metals such as Na, K, Ca, and the like. The amines useful for reacting with the acylating agent to form the product (i) including but are not limited to, monoamines, polyamines, alkanol amines, hydroxy amines, and mixtures thereof, and amines may be primary, secondary or tertiary amines.

Examples of primary and secondary monoamines include ethylamine, diethylamine, n-butylamine, di-n-butylamine, allylamine, isobutylamine, cocoamine, stearylamine, laurylamine, methyllaurylamine, oleylamine, N-methyloctylamine, dodecylamine, and octadecylamine. Suitable examples of tertiary monoamines include trimethylamine, triethylamine, tripropylamine, tributylamine, monoethyldimethylamine, dimethylpropylamine, dimethylbutylamine, dimethylpentylamnine, dimethylhexylamine, dimethylheptylamine, and dimethyloctylamine.

The amines include but are not limited to hydroxyamines, such as mono-, di- and triethanolamine, dimethylethanol amine, diethylethanol amine, di-(3-hydroxy propyl) amine, N-(3-hydroxybutyl) amine, N-(4-hydroxy butyl) amine, and N,N-di-(2-hydroxypropyl) amine; alkylene polyamines such as methylene polyamines, ethylene polyamines, butylene polyamines, propylene polyamines, pentylene polyamines, and the like. Specific examples of such polyamines include ethylene diamine, diethylene triamine, triethylene tetramine, propylene diamine, trimethylene diamine, tripropylene tetramine, tetraethylene pentamine, hexaethylene heptamine, pentaethylene hexamine, or a mixture of two or more thereof; ethylene polyamine bottoms or a heavy polyamine. The oil-soluble product (i) may be a salt, an ester, an ester/salt, an amide, an amide, or a combination of two or more thereof.

The oil soluble product (i) may be present in the emulsion at a concentration of up to about 15% by weight based on the overall weight of the emulsion, and in one embodiment about 0.1 to about 15% by weight, and an one embodiment about 0.1 to about 10% by weight, and in one embodiment about 0.1 to about 5% by weight, and in one embodiment about 0.1 to about 2% by weight, and in one embodiment about 0.1 to about 1% by weight, and in one embodiment about 0.1 to about 0.7% by weight.

The second acylating agent (ii) of this invention includes carboxylic acids and their reactive equivalents such as acid halides and anhydrides.

In one embodiment, the carboxylic acid is a monocarboxylic acid of about 1 to about 35 carbon atoms, and in one embodiment about 16 to about 24 carbon atoms. Examples of these monocarboxylic acids include lauric acid, oleic acid, isostearic acid, politic acid, stearic acid, linoleic acid, arachidic acid, gadoleic acid, behenic acid, erucic acid, tall oil fatty acids, lignoceric acid and the like. These acids may be staturated, unsaturated, or have other functional groups, such as hydroxy groups, as in 12-hydroxy stearic acid, from the hydrocarbyl backbone.

In one embodiment, the carboxylic acid is a hydrocarbyl-substituted succinic acid represented correspondingly by the formula

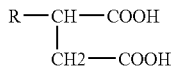

wherein formula R is hydrocarbyl group of about 12 to about 40. The production of such hydrocarbyl-substituted succinic acids or anhydrides via alkylation of maleic acid or anhydride or its derivatives with a halohydrocarbon or via reaction of maleic acid or anhydride with an olefin polymer having a terminal double bond is known to those of skill in the art.

The ionic or nonionic compound (iii) of the emulsifier has a hydrophilic-lipophilic balance (HIB, which refers to the size and strength of the polar (hydrophilic) and non-polar (lipophilic) groups on the surfactant molecule) in the range of about 1 to about 40, and in one embodiment about 4 to about 15 and is described in greater detail in U.S. Ser. No. 09/761,482, An Emulsifier For An Aqueous Hydrocarbon Fuel, incorporated by reference herein. Examples of these compounds are disclosed in *McCutcheon's Emulsifiers and Detergents,* 1998, North American & International Edition. Pages 1-235 of the North American Edition and pages 1-199 of the International Edition are incorporated herein by reference for their disclosure of such ionic and nonionic compounds having an HLB in the range of about 1 to about 40, in one embodiment about 1 to about 30, in one embodiment about 1 to 20, and in another embodiment about 1 to about 10. Examples include low molecular weight variants of (i) or (vii) such as those having a hydrocarbon group in the range of $C_8$ or $C_{20}$. Useful compounds include alkanolamines, carboxylates including amine salts, metallic salts and the like, alkylarylsulfonates, amine oxides, poly(oxyalkylene) compounds, including block copolymers comprising alkylene oxide repeat units, carboxylated alcohol ethoxylates, ethoxylated alcohols, ethoxylated alkylphenols, ethoxylated amines and amides, ethoxylated fatty acids, ethoxylated fatty esters and oils, fatty esters, fatty acid amides, including but not limited to amides from tall oil fatty acids and polyamides, glycerol esters, glycol esters, sorbitan esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkylphenols, sorbitan derivatives, sucrose esters and derivatives, sulfates or alcohols or ethoxylated alcohols or fatty esters, sulfonates of dodecyl and tridecyl benzenes or condensed naphthalenes or petroleum, sulfosuccinates and derivatives, and tridecyl and dodecyl benzene sulfonic acids.

In one embodiment the emulsifier (iv) is the reaction product of A) a polyacidic polymer, B) at least one oil soluble product made by reacting at least one hydrocarbyl-substituted carboxylic acid acylating agent, and C) a hydroxy amine and/or a polyamine and is described in greater detail in U.S. Ser. No. 09/761,482, An Emulsifier For An Aqueous Hydrocarbon Fuel, incorporated by reference herein.

The polyacidic polymers used in the reaction include but are not limited to $C_4$ to $C_{30}$; preferably $C_8$ to $C_{20}$ olefin/maleic anhydride copolymers; maleic anhydride/styrene copolymers; poly-maleic anhydride; acrylic and methacrylic acid containing polymers; poly-(alkyl)acrylates; reaction products of maleic anhydride with polymers with multiple double bonds.

The emulsifier produced from the reaction product of the polyacidic polymer with the oil soluble product (iv) comprises about 25% to about 95% of oil soluble product and about 0.1% to about 50% of the polyacidic polymer; preferably about 50% to about 92% oil soluble product and about 1% to about 20% of the polyacidic polymer, and most preferably about 70% to about 90% of oil soluble product and about 5% to about 10% of the polyacidic polymer. In one embodiment the emulsifier is described as a polyalkenyl succinimide crosslinked with an olefin/maleic anhydride copolymer.

The amino alkyl emulsifier (v) is comprised of the reaction product of an amino alkylphenol, an aldehyde, and an amine resulting in amino alkylphenol. The amino alkylphenol can be made by (a) the reaction of alkylphenol directly with an aldehyde and an amine resulting in an alkylphenol monomer connected by a methylene group to an amine, (b) the reaction of an alkylphenol with an aldehyde resulting in an oligomer wherein the alkylphenols are bridged with methylene groups, the oligomer is then reacted with more aldehyde and an amine to give a Mannich product, or (c) a mixture of (a) and (b) and is described in greater detail in U.S. Ser. No. 09/977,747 entitled A Continuous Process For Making An Aqueous Hydrocarbon Fuel Emulsion incorporated by reference herein.

The alkylphenols have an alkyl group selected from $C_1$ to $C_{200}$, preferably $C_6$ to $C_{170}$ wherein the alkyl group is either linear, branched or a combination thereof. The alkylphenols include, but are not limited to, polypropylphenol, polybutylphenol, poly(isobutenyl)phenol, polyamylphenol, tetrapropylphenol, similarly substituted phenols and the like. The preferred alkylphenols are tetrapropenylphenol and poly (isobutenyl)phenol.

The aldehydes include, but are not limited to, aliphatic aldehydes, such as formaldehyde; acetaldehyde; aldol (β-hydroxy butyraldehyde); aromatic aldehydes, such as benzaldehyde; heterocyclic aldehydes, such as furfural, and the like. The aldehyde may contain a substituent group such as hydroxyl, halogen, nitro and the like; in which the substituent does not take a major part in the reaction. The preferred aldehyde is formaldehyde.

The amines are those which contain an amino group characterized by the presence of at least one active hydrogen atom. The amines may be primary amino groups, secondary amino groups, or combinations of primary and secondary amino groups.

The amines include, but are not limited to, alkanolamines; di- and polyamine (polyalkyene amines); polyalkyl polyamines; propylenediamine, the aromatic amines such as o-, m- and p-phenylene diamine, diamino naphthalenes; the acid-substituted polyalkylpolyamines, and the corresponding formyl-, propionyl-, butyryl-, and the like N-substituted compounds; and the corresponding cyclized compounds formed therefrom, such as the N-alkyl amines of imidazolidine and pyrimidine. Substituent groups attached to the carbon atoms of these amines are typified by alkyl, aryl, alkaryl, aralkyl, cycloalkyl, and amino compounds. The amino alkylphenols emulsifier of this invention may be made by reacting the alkylphenol:aldehyde:amine in a ratio range of 1:1:0.1 molar to 1:2:2 molar, in one embodiment preferably 1:0.9:0.1 to 1:1.9:1.9, in one embodiment preferably 1:1.5:1.2 molar to 1:1.9:1.8 molar, and in one embodiment preferably 1:0.8:0.3 to 1:1.5:0.7, resulting in the amino alkylphenol emulsifier.

In another embodiment of this invention the amino alkylphenol is made by the reaction of an alkylphenol with an aldehyde. resulting in an oligomer wherein the alkylphenols are bridged with methylene groups; then the oligomer is reacted with more aldehyde and amine to give the emulsifier Mannich product of this invention. The reaction is prepared by any known method such as an emulsion, a solution, a suspension, and a continuous addition bulk process. The reaction is carried out under conditions that provide for the formation of the desired product.

The emulsifier is present in the emulsified composition at a concentration of about 0.001% to about 20% by weight, in another embodiment about 0.05% to about 10% by weight, in another embodiment about 0.1% to about 5% by weight, and in a further embodiment of about 0.1% to about 3% by weight of the emulsified composition. Combinations of emulsifiers may be used.

The emulsifier component (vi) may be a hydrocarbyl substituted carboxylic acid, or a reaction product of the hydrocarbyl substituted carboxylic acid or a reactive equivalent thereof with an alcohol. The carboxylic acids may be monobasic or polybasic. The polybasic acids include dicarboxylic acids, although tricarboxylic and tetracarboxylic acids may be used. The reactive equivalents may be acid halides, (e.g., chlorides), anhydrides or esters, including partial esters, and the like.

The alcohol which may be reacted with the hydrocarbyl substituted carboxylic acid or reactive equivalent to form emulsifier component (iii)(a) may be a mono- or a polyhydric hydrocarbon-based alcohol such as methanol, ethanol, the propanols, butanols, pentanols, hexanols, heptanols, octanols, decanols, and the like. Also included are fatty alcohols and mixtures thereof, including saturated alcohols such as lauryl, myristyl, cetyl, stearyl and behenyl alcohols, and unsaturated alcohols such as palmitoleyl, oleyl and eicosenyl. Higher synthetic monohydric alcohols of the type formed by the Oxo process (e.g., 2-ethylhexanol), by the aldol condensation, or by organoalurninum-catalyzed oligomerixation of alpha-olefins (e.g., ethylene), followed by oxidation, may be used. Alicyclic analogs of the above-described alcohols may be used; examples include cyclopentanol, cyclohexanol, cyclododecanol, and the like.

The polyhydroxy compounds that may be used include ethylene, propylene, butylene, pentylene, hexylene and heptylene glycols; tri-, tetra-, penta-, hexa- and heptamethylene glycols and hydrocarbon-substituted analogs thereof (e.g., 2-ethyl-1,3-trimethylene glycol, neopentyl glycol, etc.), as well as polyoxyalkylene compounds such as diethylene and higher polyethylene glycols, tripropylene glycol, dibutylene glycol, dipentylene glycol, dihexylene glycol and diheptylene glycol, and their monoethers. A glycol that may be used is 1,2-propane diol.

Sugar alcohols of the general formula $HOCH_2(CHOH)_{1-5}CH_2OH$ such as glycerol, sorbitol, mannitol, and the like, and their partially esterified derivatives may be used. Oligomers of such sugar alcohols, including diglycerol, triglycerol, hexaglycerol, and the like, and their partially esterfied derivatives may be used. Methylol polyols such as pentaerythritol and its oligomers (di- and tripentaerythritol, etc.), trimethylolethane, trimethylolpropane, and the like may be used.

The emulsifier component (vi) may be in the form of an acid, an ester, or a mixture thereof. The acid may be formed by reacting a hydrocarbyl substituted carboxylic acid reactive equivalent with water to provide the desired acid. For example, hydrocarbyl (e.g., polyisobutene) substituted succinic anhydride may be reacted with water to form hydrocarbyl substituted succinic acid, or with an alcohol to form and ester. The reaction between the hydrocarbyl substituted carboxylic acid or reactive equivalent thereof and the alcohol to form an ester may be carried out under suitable ester forming reaction conditions. In one embodiment, the hydrocarbyl substituted carboxylic acid or reactive equivalent thereof and the alcohol are reacted in amounts sufficient to provide from about 0.3 to about 3 equivalents of the acid or reactive equivalent thereof per equivalent of alcohol. In one embodiment, this ratio is from about 0.5:1 to about 2:1.

The emulsifier component (vii) may be at least one compound represented by one or more of the formulae:

(vii-1)

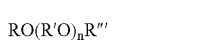

(vii-2)

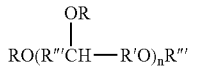

(vii-3)

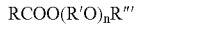

(vii-4)

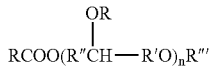

(vii-5)

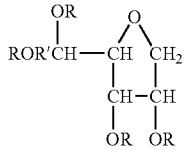

(vii-6)

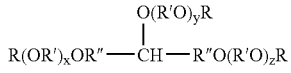

wherein each R is independently hydrogen or a hydrocarbyl group of up to about 60 carbon atoms; each R' and R" is independently an alkylene group of 1 to about 20 carbon atoms; each R"' is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1. In the above formulae, R may be a hydrocarbyl group of about 6 to about 60 carbon atoms, and in one embodiment abut 6 to about 45 carbon atoms, and in one embodiment about 6 to about 30 carbon atoms. R' and R" may be independently alkylene groups of about 1 to about 6 carbon atoms, and in one embodiment about 1 to about 4 carbon atoms. In one embodiment, R'" may be an acyl or hydrocarbyl group of 1 to about 30 carbon atoms, and in one embodiment 1 to about 24 carbon atoms, and in one embodiment 1 to about 18 carbon atoms, and in one embodiment 1 to about 12 carbon atoms. n may be a number in the range of 1 to about 50, and in one embodiment 1 to about 30, and in one embodiment 1 to about 20, and in one embodiment 1 to about 12. x, y and z may be independently numbers in the range of zero to about 50, and in one embodiment zero to about 30, and in one embodiment zero to about 10; with the total of x, y and z being at least 1, and in one embodiment in the range of 1 to about 50.

Examples of compounds represented by formula (vii-1) that may be used include: $C_9$—$C_{11}$ alkoxy poly (ethoxy)$_8$ alcohol; $C_{12}$—$C_{15}$ alkoxy poly (isopropoxy)$_{22\text{-}26}$ alcohol; oleyl alcohol pentaethoxylate; and the like.

Examples of compounds represented by formula (vii-2) that may be used include diglycerol monooleate, diglycerol monosteaate, polyglycerol monooleate, and the like.

Examples of compounds represented by formula (vii-3) that may be used include polyethylene glycol (Mn=200) distearate, polyethylene glycol (Mn=400) distearate, polyethylene glycol (Mn=200) dioleate, polyethylene glycol (Mn=400) soya bean oil ester, and the like.

Examples of compounds represented by formula (vii-4) that may be used include glycerol monooleate, diglycerol dioleate, diglycerol distearate, polyglycerol dioleate, and the like.

Examples of compounds represented by formula (vii-5) that may be used include sorbitan monooleate, sorbitan monoisostearate, sorbitan sesquioleate, and sorbitan trioleate, and the like.

Examples of compounds represented by formula (vii-6) that may be used include polyethoxy glycerol trioleate wherein the compound contains 25 ethoxy groups.

The emulsifier (viii) can be an etheramine. The etheramine used to the make the composition of this invention can be represented by the formula $$R^2O[CH_2CH(R)O]_n—R^1—NH_2 \quad \text{(viii-a)}$$

wherein each n is a number from 0 to 50; each R is selected from the group consisting of hydrogen, hydrocarbyl groups of 1 to 16 carbon atoms, and mixtures thereof; each $R^1$ is selected from the group consisting of a hydrocarbylene group containing 2 to 18 carbon atoms and a group represented by the formula $$—R^6N_p—R^7—$$

wherein both $R^6$ and $R^7$ are hydrocarbylene groups of 3 to 10 carbon atoms and p is a number from 1 to 4; and each $R^2$ is a hydrocarbyl group having a valence of y where y is a number from 1 to 3, and containing 1 to 50 carbon atoms when y is 1 and 1 to 18 carbon atoms when y is 2 or 3; provided that when n is zero, y is 1. The etheramine includes a mono ether amine, wherein n in the above formula is zero, as well as a polyetheramine, wherein n in the above formula is at least one.

The etheramines can include up to three primary amine functionalities (i.e., y in the above formula can have values of 1, 2, or 3), as well as compounds having a primary and secondary amine functionality in the same molecule.

The etheramines having one primary amino group include those where $R^1$ in the above formula is a hydrocarbylene group, so that the etheramine is represented by the formula $$R^2O(CH_2CH(R)(O)_nR^1NH_2 \quad \text{(viii-b)}$$

wherein $R^2$ is a hydrocarbyl group having 1 to 50 carbon atoms; and n and R and $R^1$ are defined as above. Preferably R is methyl, ethyl, or mixtures thereof. These correspond to the etheramine having propylene oxide (PO) or butylene oxide (BO) repeat units which are more soluble in oil than etheramines having ethylene oxide repeat units, although etheramines having mixtures of ethylene oxide (EO) and higher alkylene oxide repeat units are also contemplated for use in the emulsified compositions of this invention. In one embodiment, $R^2=C_{13}H_{27}$. In another embodiment, $R^1$=propylene group. In another embodiment, n=20.

One type of etheramines having one primary amine functionality and fitting the above structural general formula (viii-b) are etheramines represented by the formula $$R^2O(CH_2CH(R)(O)_nCH_2CH(R)NH_2 \quad \text{(viii-c)}$$

where R and $R^2$ are defined as above and n is 1 to 50. These etheramines are prepared by reaction of a monohydric alcohol initiator with an alkylene oxide where R and $R^2$are defined as above and n is 1 to 50. These etheramines are prepared by reaction of a monohydric alcohol initiator with an alkylene oxide (typically EO, PO, or BO) followed by conversion of the resulting terminal hydroxyl group to an amine. Examples of these include the commercial JEFFAMINE.™. M-Series of polyetheramines, manufactured by Huntsman Chemical company, which are prepared using ethylene and/or propylene oxide, and have terminal —$CH_2$ $CH(CH_3)NH_2$ group. Among these JEFFAMINE.™. M-600 and M-2005 are predominantly PO based having a mole ratio of PO/EO of approximately 9/1 and 32/3 respectively. These will typically have greater solubility in the hydrocarbon fuels than polyetheramines having higher concentration of EO units in the chain.

Examples of polyetheramines wherein $R^2$ is nonylphenyl include the SURFONAMINE.™. series of surface active amines, manufactured by Huntsman Chemical Company. The series consist of amines with the general structure $$R^2—[OCH_2CH_2]_x—[OCH_2CH(CH_3)]_y—NH_2 \quad \text{(viii-d)}$$

wherein $R^2$ is p-nonylphenyl, and the x/y ratio ranges from 1/2 to 12/2 as well as products containing only PO units.

Polyetheramines which are end capped with one or a few units of EO are also useful. Thus the etheramine can be represented by the formula $$R^2O[CH_2CH(CH_3)O]_{10\text{-}30}(CH_2CH_2O)_{1\text{-}5}CH_2CH_2NH_2 \quad \text{(viii-e)}$$

wherein $R_2$ is a hydrocarbyl group of 10 to 20 carbon atoms.

Another useful class of etheramines are those represented by the formula $$R_2O(CH_2CH(R)(O)_n[(CH_2)_3NH]_qH \quad \text{(viii-f)}$$

wherein q is number from 1 to 5; n is number from 0 to 50; and R and $R_2$ are defined as above. These can usually be prepared by cyanoethylating an adduct of an alcohol, or alkylphenol and an alkylene oxide with acrylonitrile and hydrogenating the obtained product, and, if necessary, followed by the repetition of the cyanoethylation and the hydrogenation steps. The cyanoethylation is typically conducted by stirring the reaction system under heating in the presence of a strong base catalyst such as caustic alkali. The hydrogenation can be conducted in the presence of a hydrogenation catalyst such as Raney nickel. In one embodiment, $R^2$ in the above formula is an alkyl group of 12 to 15 carbon atoms, R is methyl and q is 1.

In one embodiment the etheramine of formula (viii-g) is represented more specifically by the formula $$R^2O(CH_2CH(R)O)_n(CH_2)_3NH_2 \quad \text{(viii-g)}$$

When n in the above formula is zero, the etheramine is a monoetheramine. Examples of monoetheramines of the above formula include the commercial amines produced and marketed by Tomah Products, Inc. These etheramines are represented by the formula $R^2OR^1NH_2$ where $R^1$ is an alkylene group of 2 to 6 carbon atoms, and $R^2$ is defined as above. These primary ether amines are generally prepared by the reaction of an alcohol $R^2OH$ with an unsaturated nitrile. The nitrile reactant can have from 2 to 6 carbon atoms with acrylonitrile being most preferred. When acrylonitrile is used, the monoetheramine is represented by the formula $R^2O(CH_2)_3NH_2$. Typical of such etheramines are those having from 150 to 400 molecular weights.

In one embodiment, the monoetheramine is isotridecyloxypropylamine ($C_{13}H_{27}O(CH_2)_3NH_2$), available commercially from Tomah as "PA-17".

Examples of monoetheramines of the above formula wherein n is zero and q is 2 are ether diamines represented by the formula $R_2O(CH_2)_3NH(CH_2)_3NH_2$ and manufactured by Tomah Products, Inc. Specific examples include isotridecyloxypropyl-1,3 diamino propane ("DA-17") and Octyl/decyloxypropyl-1,3-diamino propane ("DA-1214") containing mixed alkyl groups.

Etheramines having two or three primary amine functionalities include the JEFFAMINE.™. diamines and triamines respectively manufactured by Huntman Chemical Company. The JEFFAMIE.™. diamines include the D-series represented by the structure $$NH_2CH(CH_3)CH_2OCH_2CH(CH_3)_xNH_2 \quad \text{(viii-h)}$$

wherein x ranges from 2 to 66, with molecular weights ranging from 230 to 4000.

In another embodiment, the emulsifier can be a phospholipids (ix). The phospholipids of the present invention may be any lipid containing a phosphoric acid, such as lecithin or cephalin, preferably lecithin or derivatives thereof. Examples of phospholipids include phosphatidylcholine, phosphatidylserine, phosphatidylinositol, phosphatidylethanolamine, phosphotidic acid and mixtures thereof. Preferably, the phospholipids are glycerophospholipids, more preferably, glycerol derivatives of the above list of phospholipids. Typically, the glycerophospholipids have one or two acyl, alkyl or alkenyl groups on a glycerol residue. The alkyl or alkenyl groups generally contain from about 8 to about 30 carbon atoms, preferably 8 to about 25, more preferably 12 to about 24. Example of these groups include octyl, dodecyl, hexadecyl, octadecyl, docosanyl, octenyl, dodecenyl, hexadecenyl and octadecenyl.

The acyl groups on the glycerophospholipids are generally derived from fatty acids. Fatty acids are acids having from about 8 to about 30 carbon atoms, preferably about 12 to about 24, more preferably about 12 to about 18.

Examples of fatty acids include muriatic, politic, stearic, oleic, linoleic, linolenic, arachidic, arachidonic acids, or mixtures thereof, preferably stearic, oleic, linoleic, and linolenic acids or mixtures thereof.

In the present invention, derivatives of phospholipids may also be used. Derivatives of phospholipids may be acylated or hydroxylated phospholipids. For instance, lecithin as well as acylated and hydroxylated lecithins may be used in the present invention. Acylated lecithins may be prepared by reacting an acylating agent with a lecithin.

Phospholipids may be prepared synthetically or derived from natural sources. Synthetic phospholipids may be prepared by methods known to those in the art. Naturally derived phospholipids are extracted by procedures known to those in the art. Phospholipids may be derived from animal or vegetable sources. The animal sources include fish, fish oil, shellfish, bovine brain or any egg, preferably chicken eggs. Vegetable sources include rapeseed, sunflower seed, peanut, palm kernel, cucurbit seed, wheat, barley, rice, olive, mango, avocado, palash, papaya, jangli, bodani, carrot, soybean, corn, and cottonseed, more preferably soybean, corn, sunflower and cottonseed. Phospholipids may be derived from microorganisms, including blue-green algae, green algae, bacteria grown on methanol or methane and yeasts grown on alkanes.

Phospholipids and lecithins are described in detail in Encyclopedia of Chemcial Technology, Kirk and Othmer, 3rd Edition, in "Fats and Fatty Oils", Volume 9, pages 795-831 and in "Lecithins", Volume 14, pages 250-269.

The above disclosures of phospholipids and lecithins are hereby incorporated by reference.

The emulsifier may also be $$R—NH2 \quad \text{(x)}$$

where R=a poly(isobutenyl) group in a molecular weight of 350 to 3000. In a preferred embodiment, the poly(isobutenyl) group has a Mn=1000.

Optionally, an alcohol may be employed in the emulsified composition. Typical alcohols include but are not limited to polyol-, ethylene glycol, propylene glycol, methanol, ethanol, glycerols and mixtures thereof.

The alcohol may be present in the range of about 0% to about 30% preferably about 1% to about 20%, and more preferably about 2% to about 10%by weight of the emulsified composition.

Process

In the practice of the present invention the emulsified composition is made by a batch, semi-batch or a continuous process. The process is capable of monitoring and adjusting the flow rates of the oil of lubricating viscosity, emulsifier(s), other additives and/or water to form a stable emulsion with the desired water droplet size.

The emulsified composition may be prepared by the steps of mixing the oil of lubricating viscosity, the emulsifier, and other oil soluble additives using shear techniques to form the additive mixture. Then the additive mixture is mixed with water and optionally any desired water soluble additives to form the desired emulsified composition.

In a batch process the water, the emulsifier(s), the oil of lubricating viscosity and optional additives are added to a tank, in the desired amounts. The mixture is emulsified using an emulsification device in the vessel, or alternatively the mixture flows from the vessel via a circular line to the emulsification device which is external to the vessel, for about 1 to about 20 tank turnovers. The temperature in the range of about ambient temperature to about 200° C., and in another embodiment in the range of about 4° C. to about 150° C., and in another embodiment in the range of about 15° C. to about 90° C. and at a pressure in the range of about atmospheric pressure to about 300 psi, in another embodiment in the range of about atmospheric pressure to about 75 psi and in another embodiment in the range of atmospheric pressure to about 50 psi.

The continuous process described herein depicts another embodiment of the invention. The feeds of the oil of lubricating viscosity, emulsifier(s), water and optional additives are introduced as discrete feeds or in the alternative combinations of the discreet feeds. The processing streams are introduced in or as close to the inlet of the emulsification device as possible. It is preferable that the emulsifier is added to the oil of lubricating viscosity as a oil of lubricating viscosity emulsifier stream prior to the discreet feeds combining together. The continuous process generally occurs under ambient conditions. The continuous process generally occurs at atmosphere pressure to about 20,000 psi, in another embodiment in the range of about atmospheric pressure to about 5,000 psi, and in another embodiment in the range of about atmospheric pressure to about 1,000 psi. The continuous process generally occurs at ambient temperature. In one embodiment the temperature is in the range of about ambient temperature to about 200° C., and in another embodiment in the range of about 4° C. to about 150° C. and in another embodiment about 10° C. to about 100° C.

Alternatively, a concentrate is formed and all or substantially all the water, and water soluble additive and a portion of the oil of lubricating viscosity and all or substantially all the emulsifiers and oil soluble additives are emulsified under shear conditions to form a concentrate oil of lubricating viscosity. The emulsified composition, when used, is then blended under normal mixing conditions with the remaining portion of the oil of lubricating viscosity.

The emulsification may occur at shear conditions that are greater than 50,000 $s^1$. However, the composition may be emulsified at shear process conditions and occurs at a shear rate in the range of less than or equal to 50,000 $s^1$, and in another embodiment less the about 20,000 $s^1$, and in another embodiment less the about 1,000 $s^1$, and in another embodiment less than 100 $s^1$, and in another embodiment less than 1 $s^1$. If more than one emulsification step is used, the shear rates of the emulsification steps can be the same, similar or different, depending on the emulsifier and low molecular weight surfactant used. The emulsification provides for the desired particle size and a uniform dispersion of water in the oil of lubricating viscosity.

The emulsification occurs by any shear method used in the industry including but not limited to mixing, mechanical mixer agitation, static mixers, centrifugal pumps, positive displacement pumps, orifice plates, and the like. Examples of the devices include but are not limited to an Aquashear, pipeline static mixers, rotor/stator mixers and the like. The Aquashear is a low-pressure hydraulic shear device. The Aquashear mixers are available from Flow Process Technologies, Inc.

The process may be in the form of a containerized equipment unit that operates automatically. The process can be programmed and monitored locally at the site of its installation, or it can be programmed and monitored from a location remote from the site of its installation. The fully formulated emulsified composition is optionally dispensed to end users at the installation site, or in another embodiment end users can blend the concentrated emulsion with the final portion of oil of lubricating viscosity. This provides a way to make the water in oil of lubricating viscosity emulsions available to end users in wide distribution networks.

A programmable logical controller is optionally employed for governing the flow of components in the batch, semi-batch or continuous process, thereby controlling the flow rates and mixing ratio in accordance with the desired blending rates.

The emulsification provides for the desired particles size and a uniform dispersion of the water in the oil. The emulsification results in a uniform dispersion of an emulsified composition having a mean particle droplet size in the range of 0.01 micron to about 20 micron, in another embodiment in the range of about 0.5 micron to about 10 micron, and in another embodiment of the range of about 1 micron to about 5 micron.

SPECIFIC EMBODIMENT

The following examples demonstrate the emulsified composition of the invention.

EXAMPLE 1

A 3-speed Hobart N-50 mixer was used as the blending vessel for the emulsion grease. A 5-qt mixing bowl was charged with 144 g of soybean oil, 32 g of a multifunctional performance additive package [75% olefin polysulfide, 12.5% thiadiazole metal deactivator, and 12.5% dithiophosphoric acid ester antiwear agent] and 32 g of a surfactant system [33% polyisobutenylsuccinic acid, 50% alkylpolyoxyalkylbutylamine, and 17% diluent oil]. The components were stirred with a whisk attachment at low speed and room temperature.

A solution of 40 g of potassium nitrate in 552 g of water was added dropwise to the mixing bowl over 4-5 minutes while low speed mixing continued. After an additional minute of low-speed mixing, the mixing was increased to high speed for five minutes. The product was collected as a viscous, grease-like emulsion.

EXAMPLE 2

A 3-speed Hobart N-50 mixer was used as the blending vessel for the emulsion. A 5-qt mixing bowl was charged with 144 g of petrolatum, 32 g of a multifunctional performance additive package [75% olefin polysulfide, 12.5% thiadiazole metal deactivator, and 12.5% dithiophosphoric acid ester antiwear agent] and 32 g of a surfactant system [33% polyisobutenylsuccinic acid, 50% alkylpolyoxyalkylbutylamine and 17% diluent oil]. The components were stirred with a paddle attachment at medium speed and room temperature.

A solution of 40 g of potassium nitrate and 552 g of water was added dropwise to the mixing bowl over 30-50 minutes while medium speed mixing continued. The mixing was then maintained at medium speed for an additional 30 minutes. The product was collected as a viscous, grease-like emulsion.

EXAMPLE 3

A 3-speed Hobart N-50 mixture was used as the blending vessel for the emulsion. A 5-qt mixing bowl was charged with 93 g of a 12-hydroxy lithium sterate based NLGI-2 grease, 24 g of titanium dioxide, 31 g of a calcium sulfonate and 31 g of a surfactant system [25% sorbitan monooleate, 50% polyisobutenylsuccinic acid and 25% diluent oil]. The components were stirred with a paddle attachment at medium speed and room temperature.

A solution of 39 g of glycerol and 582 g of water was added dropwise to the mixing bowl over 30-50 minutes while medium speed mixing continued. The mixing was then maintained at medium speed for an additional 30 minutes. The product was collected as a viscous, grease-like emulsion.

EXAMPLE 4

A 3-speed Hobart N-50 mixture was used as the blending vessel for the emulsion. A 5-qt mixing bowl was charged with 64 g of a 600N mineral oil, 64 g of petrolatum, 32 g of an oxidized petrolatum having a total acid content of 45-60 (mg KOH/g) per ASTM 974, and 32 g of a polyisobutenylsuccinic acid surfactant system comprised of 66% polyisobutenylsuccinic acid and 34% diluent oil. The components were stirred with a paddle attachment at medium speed and room temperature.

A solution of 80 g of glycerol and 528 g of water was added dropwise to the mixing bowl over 30-50 minutes while medium speed mixing continued. The mixing was then maintained at medium speed for an additional 30 minutes. The product was collected as a viscous, grease-like emulsion.

In the above description and examples of invention those skilled in that will perceive improvements, changes and modifications in the invention. Such improvements, changes and modifications within the skill of the art are intended to be covered by the following claims.

What is claimed is:

1. An emulsified composition comprising a major amount of water in the range of about 99% to about 5% by weight of the emulsified composition, a minor amount of an oil in the range of about 1% to about 95% by weight of the emulsified composition, at least one thickener, at least one of water soluble additives, oil soluble additives, alcohols, solid additives and combinations thereof, and a minor but effective amount of emulsifier to emulsify the aqueous and organic phase resulting in a water in oil emulsified composition wherein the emulsifier comprises one or more surfactants, wherein the emulsifier has a hydrophilic lipophilic balance (HLB) less than 9, and wherein the one or more surfactants that make up the emulsifier are selected from the group consisting of:

(i) a oil soluble product made by reacting at least one hydrocarbyl-substituted carboxylic acid acylating agent with ammonia or an amine, the hydrocarbyl substituent of said acylating agent having about 50 to about 500 carbon atoms;

(ii) any other acylating agent having at least one hydrocarbyl substituents of up to about 40 carbon atoms, and reacting that said acylating agent with ammonia or an amine;

(iii) any other ionic or a nonionic compound having a hydrophilic-lipophilic balance (HLB) of about 1 to about 40;

(iv) the reaction product of polyacidic polymer with at least one oil soluble product made by reacting at least one hydrocarbyl-substituted carboxylic acid acylating agent with ammonia, an amine, a polyamine, an alkanol amine or hydroxy amines;

(v) an amino alkylphenol which is made by reacting an alkylphenol, an aldehyde and an amine resulting in an amino alkylphenol;

(vi) a hydrocarbyl substituted carboxylic acid, or a reaction product of the hydrocarbyl substituted carboxylic acid or a reactive equivalent of such acid with an alcohol, the hydrocarbyl substituent of the acid or reactive equivalent thereof containing at least about 30 carbon atoms;

(vii) at least one compound represented by one or more of the formulae:

(vii-1)

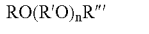

(vii-2)

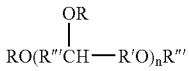

(vii-3)

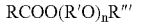

(vii-4)

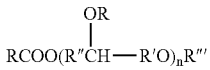

(vii-5)

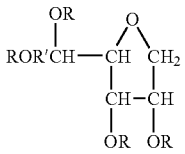

(vii-6)

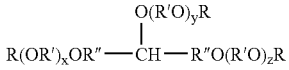

wherein each R is a hydrocarbyl group of up to about 60 carbon atoms; each R' and R" is independently an alkylene group of 1 to about 20 carbon atoms; each R'" is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1;

(viii) an etheramine used to the make the composition of this invention can be represented by the formula $$R^2O[CH_2CH(R)O]_n—R^1—NH_2$$

wherein each n is a number from 0 to 50; each R is selected from the group consisting of hydrogen, hydrocarbyl groups of 1 to 16 carbon atoms, and mixtures thereof; each $R^1$ is selected from the group consisting of a hydrocarbylene group containing 2 to 18 carbon atoms and a group represented by the formula $$—R^6N_p—R^7—$$

wherein both $R^6$ and $R^7$ are hydrocarbylene groups of 3 to 10 carbon atoms and p is a number from 1 to 4; and each $R^2$ is a hydrocarbyl group having a valence of Y where Y is a number from 1 to 3, and containing 1 to 50 carbon atoms when Y is 1 and 1 to 18 carbon atoms when Y is 2 or 3; provided that when n is zero, Y is 1;

(ix) a phospholipid, any lipid containing a phosphoric acid;

(x)an amine represented by the formula:

$$R^3—NH_2$$

where $R^3$=a poly(isobutenyl) group of molecular weight between 350 and 3000, and (xi) a combination of any other above listed surfactants;

wherein the emulsified composition has a viscosity in the range of about 200 to about 2,000,000 cPs measured on a Brookfield Viscometer with a No. 7 spindle at 20 rpm at 250° C.; and wherein the oil comprises natural oils, synthetic oils, alkylene oxide polymers, esters of dicarboxylic acids, unrefined oils, refined oils, re-refined oils, waxes, oil of lubricating viscosity or combinations thereof, wherein the oil soluble additives are selected from the group consisting of extreme pressure anti-wear additives, metal deactivators, dispersants, antifoams, corrosion rust inhibitors, antioxidants, detergents, polymers, viscosity modifier, functionalized polymers and combinations thereof, wherein the antioxidants comprised of phenate sulfides, phosphosulfurized terpenes, sulfurized esters, aromatic amines, hindered phenols or combinations thereof and wherein the antioxidants are present in the range of about 0% to about 10% by weight of the emulsified composition.

2. The composition of claim 1 wherein the water soluble additives are selected from the group consisting of at least one of alcohols; extreme pressure anti-wear additives; water soluble salts, selected from the group consisting of dihydrogen butyl phosphate, water soluble dithiophosphate salts and combinations thereof; water soluble inorganic salts selected from the group consisting of xanthates, dithiocarbonates, trithiocarbonates, sulfates, sulfites, sulfides and combinations thereof; water soluble phosphate esters, phosphites, phosphonates, dithiophosphate esters; water soluble rust inhibitors selected from the group consisting of morpholine and alkanolamines, phosphorous and phosphoric acid derivatives including mono and diesters and amine or metallic salts of phosphoric and phosphorous acid, thickeners and combinations thereof and wherein the water soluble additives are present in the range of about 0% to about 50% by weight of emulsified composition and the oil soluble additives are present in the range of about 0% to about 75% by weight of the emulsified composition.

3. The composition of claim 1 wherein the metal deactivators comprise benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles or combinations thereof and wherein the metal deactivators are be present in the range of 0% to about 5% by weight of the emulsified composition.

4. The composition of claim 1 wherein the oil soluble additives comprise oil soluble detergents wherein the oil soluble detergents comprise overbased materials prepared by reacting an acidic material with a mixture comprising an acidic organic compound, a reaction medium comprising at least one inert, organic solvent for the acidic organic material, a stoichiometric excess of a metal base, and a promoter and wherein the detergent is present in the range of about 0% to about 8% by weight of the emulsified composition.

5. The composition of claim 1 wherein the antifoams comprise organic silicones, dimethyl silicone or combinations thereof and where the antifoams are present in the range of about 0% to about 2% by weight of the emulsified composition.

6. The composition of claim 1 wherein the antirust compounds comprise alkyl substituted aliphatic dicarboylic acids, alkenyl acids, succinic acids, sulfonates relating to the metal detergent, sodium nitrite, calcium salts of oxidized paraffin wax, magnesium salts of oxidized paraffin wax, alkali metal salts, alkaline earth metal salts or amine salts of beef tallow fatty acids, alkenyl succinates or alkenyl succinic acid half esters, glycerol monoesters, nonylphenyl ethoxylate, lanolin fatty acid esters, calcium salts of lanolin fatty acids, or combinations thereof and wherein the antirust compound is present in the range of about 0% to about 10% by weight of the emulsified composition.

7. The composition of claim 1 wherein the emulsifier comprises a mixture of the reaction product of a fatty acid with an alkanol amine; and the reaction product of a polyisobutene substituted succinic acid or anhydride with an alkanol amine or an alkylene polyamine, the polyisobutene substitutent having a number average molecular weight of about 300 to about 3000.

8. The composition of claim 1 wherein the emulsifier comprises a polyisobutene substituted succinic acid and wherein the oil comprises an oil of lubricating viscosity.

9. The composition of claim 1 wherein the emulsifier comprises a polyisobutene substituted succinic acid, wherein the polyisobutene has a number average molecular weight of 2300.

10. The composition of claim 1 wherein the emulsifier is present in the range of about 20% to about 0.25% by weight of the emulsified composition.

11. A process to produce an emulsified composition comprising:

A. mixing the following components
- (a) a major amount of water,
- (b) a minor amount of an oil,
- (c) an emulsifier, wherein the emulsifier comprises one or more surfactants, and wherein the emulsifier has an overall hydrophilic lipophilic balance (HLB) of less than 9,
- (d) optionally, one or more water soluble additives,
- (e) optionally, one or more oil soluble additives,
- (f) optionally, one or more alcohols,
- (g) one or more thickeners, or
- (h) combination thereof;

B. with sufficient shear to form a water in oil emulsified composition, wherein the temperature is in the range of ambient temperature to about 200° C., and the pressure is in the range of about atmosphere pressure to about 20,000 psi; and wherein the one or more surfactants that make up the emulsifier are selected from the group consisting of:

(i) a oil soluble product made by reacting at least one hydrocarbyl-substituted carboxylic acid acylating agent with ammonia or an amine, the hydrocarbyl substituent of said acylating agent having about 50 to about 500 carbon atoms (ii) any other acylating agent having at least one hydrocarbyl substituents of up to about 40 carbon atoms, and reacting that said acylating agent with ammonia or anamine;

(iii) any other ionic or a nonionic compound having a hydrophilic-lipophilic balance (HLB) of about 1 to about 40;

(iv) the reaction product of polyacidic polymer with at least one oil soluble product made by reacting at least one hydrocarbyl-substituted carboxylic acid acylating agent with ammonia, an amine, a polyamine, an alkanol amine or hydroxyamines;

(v) an amino alkylphenol which is made by reacting an alkylphenol, an aldehyde and an amine resulting in an amino alkylphenol;

(vi) a hydrocarbyl substituted carboxylic acid, or a reaction product of the hydrocarbyl substituted carboxylic acid or a reactive equivalent of such acid with an alcohol, the hydrocarbyl substituent of the acid or reactive equivalent thereof containing at least about 30 carbon atoms;

(vii) at least one compound represented by one or more of the formulae:

$$RO(R'O)_nR''' \quad \text{(vii-1)}$$

$$RO(R'''\overset{\overset{\displaystyle OR}{|}}{C}H{-}R'O)_nR''' \quad \text{(vii-2)}$$

$$RCOO(R'O)_nR''' \quad \text{(vii-3)}$$

-continued (vii-4)

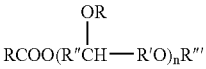

(vii-5)

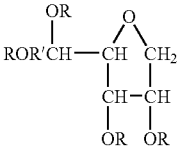

(vii-6)

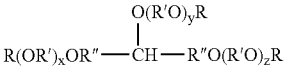

wherein each R is a hydrocarbvl group of up to about 60 carbon atoms; each R' and R" is independently an alkylene group of 1 to about 20 carbon atoms; each R'" is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1;

(viii) an etheramine used to the make the composition of this invention can be represented by the formula $R^2O[CH_2CH(R)O]_n—R^1—NH_2$ wherein each n is a number from 0 to 50; each R is selected from the group consisting of hydrogen, hydrocarbyl groups of 1 to 16 carbon atoms, and mixtures thereof; each $R^1$ is selected from the group consisting of a hydrocarbylene group containing 2 to 18 carbon atoms and a group represented by the formula $—R^6N_p—R^7—$ wherein both $R^6$ and $R^7$ are hydrocarbylene groups of 3 to 10 carbon atoms and p is a number from 1 to 4; and each $R^2$ is a hydrocarbyl group having a valence of Y where Y is a number from 1 to 3, and containing 1 to 50 carbon atoms when Y is 1 and 1 to 18 carbon atoms when Y is 2 or 3; provided that when n is zero, Y is 1;

(ix) a phospholipid, any lipid containing a phosphoric acid;

(x) an amine represented by the formula:

$R^3—NH_2$ where $R^3$=a poly(isobutenyl) group of molecular weight between 350 and 3000, and (xi) a combination of any other above listed surfactants;

wherein said emulsified composition has a viscosity in the range of about 200 to about 2,000,000 cPs measured on a Brookfield Viscometer with a No. 7 spindle at 20 rpm at 25° C.

* * * * *

UNITED STATES PATENT AND TRADEMARK OFFICE

CERTIFICATE OF CORRECTION

PATENT NO. : 7,435,707 B2
APPLICATION NO. : 10/657671
DATED : October 14, 2008
INVENTOR(S) : Deborah A. Langer et al.

It is certified that error appears in the above-identified patent and that said Letters Patent is hereby corrected as shown below:

In claim 1, at column 22, lines 61 to 62 of the issued patent, the temperature specified at which to measure the viscosity of the claimed emulsified composition reads "250° C" when it should read "25° C". The clause of claim 1, starting at column 22, line 59 and ending at column 22, line 62 should read as follows:

> wherein the emulsified composition has a viscosity in the range of about 200 to about 2,000,000 cPs measured on a Brookfield Viscometer with a No. 7 spindle at 20 rpm at 25° C.;

Signed and Sealed this
Twenty-fourth Day of July, 2012

David J. Kappos

David J. Kappos
*Director of the United States Patent and Trademark Office*